US010220430B2

(12) United States Patent
Sadri

(10) Patent No.: US 10,220,430 B2
(45) Date of Patent: Mar. 5, 2019

(54) METHOD OF FABRICATING A ONE-PIECE METAL VEHICLE WHEEL BY HYDRO FORMING PROCESS

(71) Applicant: Ali Sadri, Parand (IR)

(72) Inventor: Ali Sadri, Parand (IR)

( * ) Notice: Subject to any disclaimer, the term of this patent is extended or adjusted under 35 U.S.C. 154(b) by 473 days.

(21) Appl. No.: 14/880,291

(22) Filed: Oct. 12, 2015

(65) Prior Publication Data

US 2017/0100762 A1 Apr. 13, 2017

(51) Int. Cl.

| | |
|---|---|
| ***B21D 26/033*** | (2011.01) |
| ***B21D 53/26*** | (2006.01) |
| ***B21D 26/049*** | (2011.01) |
| ***B21D 26/039*** | (2011.01) |
| ***B21D 53/30*** | (2006.01) |

(52) U.S. Cl.

CPC ..... *B21D 26/033* (2013.01); *B21D 26/039* (2013.01); *B21D 26/049* (2013.01); *B21D 53/264* (2013.01); *B21D 53/30* (2013.01); *Y10T 29/49503* (2015.01)

(58) Field of Classification Search

CPC .. B21D 26/033; B21D 26/039; B21D 26/041; B21D 26/047; B21D 53/264; B21D 11/02; B21D 53/26; B21D 53/261; B21D 22/205; B21D 26/02; B21D 39/203; B60B 3/02; B21K 1/42; B21J 5/04; B29C 2791/007; B60G 2206/8107; Y10T 29/49453; Y10T 29/49481; Y10T 29/49503; Y10T 29/49492; Y10T 29/49806

See application file for complete search history.

(56) References Cited

U.S. PATENT DOCUMENTS

| | | | | |
|---|---|---|---|---|
| 4,557,128 A * | 12/1985 | Costabile | ..... | B21D 26/033 29/421.1 |
| 5,600,983 A * | 2/1997 | Rigsby | ..... | B21C 37/154 29/421.1 |
| 7,269,986 B2 * | 9/2007 | Pfaffmann | ..... | B21D 26/033 72/342.94 |
| 2013/0298628 A1 * | 11/2013 | Chung | ..... | B21D 26/041 72/57 |

* cited by examiner

*Primary Examiner* — Sarang Afzali
(74) *Attorney, Agent, or Firm* — Azadeh Saidi

(57) ABSTRACT

A new method of building a vehicle wheel utilizing "hydro forming" from a solid piece of steel metal sheet.

4 Claims, 11 Drawing Sheets

METHOD OF FABRICATING A ONE-PIECE METAL VEHICLE WHEEL BY HYDRO FORMING PROCESS

BACKGROUND OF THE INVENTION

Nowadays, most automobile vehicle wheels where the tire is mounted on (vehicle wheel) are built of few components. Vehicle wheel and their components are made via a complex process with sheet steel or Aluminum alloy metal cast molding method and then components are welded or connected together to make a complete and finished vehicle wheel. This invention demonstrates a new method to overcome the shortcomings of the current processes.

SUMMARY OF THE INVENTION

This invention describes how to build a vehicle wheel from one solid piece of a sheet steel metal via the "Hydro Forming" method, instead of the complex and more costly cast molding method, thus revolutionizing the industry and increasing profit.

In order to build an automobile vehicle wheel from one solid piece of sheet steel, the method of "Hydro Forming" is introduced in this document utilizing the following eight (8) summarized steps:

As the first station of raw sheet by the form stretch a piece of cylindrical.

Secondly outer vehicle wheel diameter cylindrical piece is the desired size trim.

In the third and main stage, hydro formic action is taken, so that the form and the final stretch are done on the cylindrical piece.

In the fourth, fifth, sixth and seventh steps, respectively, during the four phases press the valve opening (valve hole), a preservative holes in the wheel (wheel mounting), the central hole and air holes are forming punch. Thus, one-piece steel vehicle wheel with a double edge production is very strong.

Step 8: The edges of the holes are rounded and the outside of the vehicle wheel where visible is coated.

The above eight steps create a vehicle wheel out of one solid piece of steel metal blank cylindrical tube that is very durable, quicker to build, cost effective, more economical, and more profitable. Figures and pictures of the prototype are attached to this document to demonstrate that actual mold and all its parts, pieces, and mechanical hydro formic have been designed, built and utilized to make the prototype of the automobile Vehicle wheel.

LIST OF PARTS USED

1—Double edge
2—Valve hole
3—Air holes
4—Preservatives holes
5—Central hole
6—Rod
7—The fluid path
8—Work piece
9—Matrix
10—Plate holder
11—Jaws
12—Ejector pins
13—Hydraulic jacks
14—Final wheel
15—Hub edge

DETAILED DESCRIPTION OF THE INVENTION

With respect to the current progressive needs for automobile vehicle wheel (all complex industrial parts that need to indirect stretch) although mass production of industrial steel vehicle wheel are less expensive than the Aluminum alloy vehicle wheel and "traditional" method but require tedious and expensive process. Vehicle wheel are produced in an inefficient method in particular combination of two or more pieces that require pull and weld adds to the production problems, resulting in a lengthier production time with higher cost and less quality product here in referred to as the "traditional" method.

Note: the indirect stretch in this text is stretching that the usual methods cannot create and in this way we can create this stretch and form by fluid pressure.

With application of various mechanism components in hydro forming molding, production of steel vehicle wheel are possible with one piece of cylindrical steel metal tube that result in higher strength, better quality and efficiency can be achieved.

In the innovative design, the production costs can be significantly reduced because the production line/assembly is not only utilized to make automobile steel vehicle wheel with faster production time, but also the hydro forming mold can be readjusted based on other product specification requirements to produce other products, thus making the hydro forming mold a universal production equipment and add to the efficiency and profitability factors of mass production of various industrial products. The traditional method of vehicle wheel production in the complex process is forced to only one product use and has no other use, thus making the molding and manufacturing inefficient and more expensive. But in the introduced method usually the facility and preparation are a universal process and the capability of changing from one product line to another different product line is possible. The traditional method of vehicle wheel production in addition to an expensive and lengthy process made of several pieces that require pulling, inserting and welding lacks strength and safety.

Figure 7A:
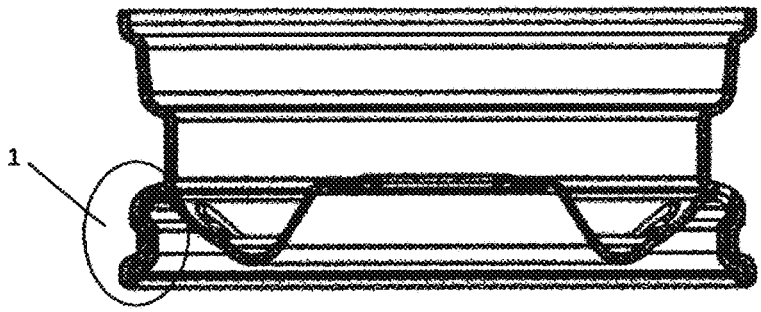
FIGS. 7A and 7B are respectively plan view and isometric view of the complete vehicle wheel by hydro forming method.
Figure 7B:
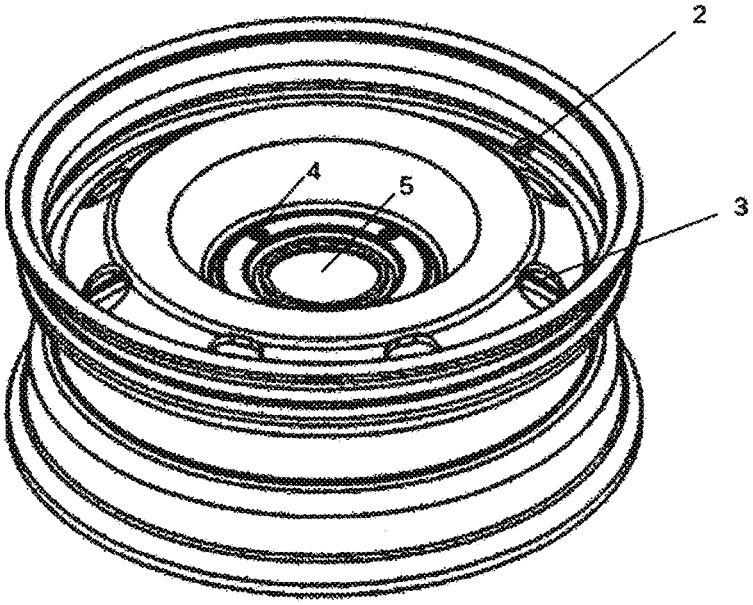

Furthermore, the traditional method from the lack of quality causes more difficulty to achieve a proper vehicle wheel balance, and because of being made from several pieces portrait an unappealing vehicle wheel façade issue and forces the manufacturer to add additional "Hub Cab" to try to solve the façade issue problem. The traditional vehicle wheel manufacturing method includes at least two pieces that are welded together as shown in figure includes "Hub" and vehicle wheel that are welded together and significantly reduces from the appeal of the appearance of the vehicle wheel. But in the introduced method only one piece is utilized (as shown in FIG. 7) that is encompassed of several advantages such as more efficient, cost effective, and more durable and does not require hub cab.

Introduction of Hydro Forming Method:

Hydro Forming method is indirect formation and stretch utilizing "fluid (oil or water)" otherwise known as "Fluid Mechanic" which is mechanical formation via the use of water or oil pressure to create various shapes and forms on cylindrical steel tube work piece.

Unlike traditional manufacturing method, the hydro forming method is capable of forming the sheet steel in any shape or form with higher manufacturing speed and less cost.

The fluidity causes have several advantages and benefit in the hydro forming method listed as follows:

1. Higher speed in production of specific industrial pieces
2. Attention and high quality due to the use of hydro forming method.
3. Attracting and convincing investors of the reduction of production cost and increase in production quality and profitability.
4. Simplicity in production in particular in production of other similar products via the universal and multipurpose use of the hydro forming mold.
5. Simplicity of facilities and production machines due to the technology and the particular complexity of the method
6. High speed in changing the production process from piece to piece Other universal and multipurpose use of the hydro forming method is other applications for other industrial products such as various forms of: pulley; other machinery vehicle wheel; oil refinery industry; petrochemistry; Etc., can be mentioned to attract investors in other manufacturing industries other than the automobile industry.

Explanation and Comparison:

In this section, explanation covered above will be presented with more specific details in a comparative way to compare the introduced and traditional methods.

A—Automobile vehicle wheel is an important component including integral operational transportation and safety. The traditional production of steel vehicle wheel are mostly made of at least two separate pieces welded together to make one complete vehicle wheel by many automobile manufacturing companies worldwide. The welded method requires massive investment with astronomical costs associated with producing two or more required steel pieces, molding, welding and other associated costs to produce welded vehicle wheel. Therefore, the traditional method production requires longer and more expensive process. However, the introduced one piece vehicle wheel production require only one mold, less time consuming eight (8) step process, less cost and more productive to mass produce steel vehicle wheel. Furthermore, the introduced method requires less equipment, less molds, and no welding is required what so ever. Also, the introduced method as mentioned before has other advantages such as a multipurpose and multi use hydro forming mold and not only will produce vehicle wheel, but also will be able to produce other similar industrial products.

B—Because vehicle wheel are one of the automobile's important features that are visible to consumer eyes, more attention must be dedicated to create an eye catching and slick product. The traditional method uses hub cab to hide the ugly side of the steel welded vehicle wheel. Hub cabs themselves are a big issue too. First, hub cab is made from steel or plastic that requires more cost and time to produce. Second, hub cabs keep becoming loose and fall out endangering driver safety and are a liability. Third, hub cab is an environmental hazard because when they become lose and fall out of the automobile wheel, they fly in highways due to high speed, roll to street, getting crushed by other automobile traffic, become a liability issue, or eventually become trash which create more environmental and pollution issues. However, the introduced method is made of only one attractive steel piece and requires no hub cab, thus saving the investors more capital.

C—Another important factor is the weight of the vehicle wheel and tire. Vehicle wheel and tires are susceptible to road condition such as paving type, bumps, deeps, cracks, holes, and other road defects that will exert an enormous stress and strain negatively impacting the vehicle wheel and tire longevity and proper operation. Therefore, the lighter the vehicle wheel and tire, the smoother the rides with less fuel consumption due to less weight haul. In the traditional method, vehicle wheel are heavier because they are made of at least two welded pieces and requite hub cab that adds to the overall weight of a final product. In the introduced method, hydro forming vehicle wheel are lighter than the traditional steel welded vehicle wheel because the entire vehicle wheel is made of only one piece that require no welding and hub cab, thus require less fuel to operate the automobile which is another advantage that reduces the greenhouse effect and carbon emission that is better for the environment.

D—Another factor to consider is the vehicle wheel and tire "Balance". Lack of balance is in the presence parts of light or heavy vehicle wheel, cranking radial or axial and non uniformity in the thickness of sheet used in vehicle wheel or non-uniformity in the thickness of welds. Two lack of balance occur due to heavy or light spots, it is completely dissolved in the both the lack of balance.

E—Also comparing the introduced hydro forming steel vehicle wheel with other types of vehicle wheel made with hot cast "Aluminum Alloy" and "Cast Iron" and even the welded method is the strength. Aluminum alloy, cast iron and welded vehicle wheel are very brittle, making them very dangerous during automobile crashes that could break in sharp pieces and cause penetration in body or other objects, and even could cause automobile roll over when impact is made, thus creating another liability issue the investors need to worry about. However, vehicle wheel made with the hydro forming method have more strength and because they are made of one solid piece, there is less chance for them to break and thus reduce liability in this area as well.

The introduced hydro forming method is safer in comparison to Aluminum alloy, cast iron and welded steel vehicle wheel because of the one piece vehicle wheel factor that will be less susceptible to breaking as the result of a crash, making the one piece vehicle wheel more durable and safer product.

Therefore, the advantages and benefits of the one piece vehicle wheel can be summarized as follows:

a. The possibility of making parts that were not produced so far due to the lack of a suitable production method.
b. Substantial decrease in mass production cost.
c. Reduction in extra pieces used in other types of vehicle wheel manufacturing such as the welded steel vehicle wheel.
d. High quality and extreme durability due to the one-piece steel factor and remove unstable welding processes
e. Increasing attractive façade due to the lack of welding and other fittings.
f. Efficiency and high production rate due to the decline of the manufacture vehicle wheel process
g. Require less investment capital/finances.
h. Require less factory space due to reduction of molds, machinery, equipment and tools not required for this type of vehicle wheel production.
i. Environmental advantage due to less production steps.
j. Safer and more durable than welded vehicle wheel, thus reduces the overall liability and the liability costs substantially.
k. Overall less production costs and more profitability.

Other industries that can benefit from the same method that build one piece includes but not limited to:

l. Automobile industry such as various vehicle wheels, pulley, fuel containers, etc.
m. Oil and petroleum industry such as vibrating connections.
n. Defense and military industry
o. Laboratory industry
p. Etc.

Descriptive Manufacturing Process:

The following is a step by step descriptive manufacturing process including figures for reference, demonstration and clarification purposes. Please note that a reference page is also attached to this document that provides name and definition of every part of the hydro forming mold and the vehicle wheel as well as other sections referenced and explained in the body of this document.

First Step: With respect to the automobile manufacturer specifications, type and size of the automobile vehicle wheel and selection of specific steel metal blank, press begins with forming the cylindrical shape steel to a range of about 1.4 to 1.8 times the vehicle wheel final specified height is demonstrated in FIG. 1. H is the final specified width of the vehicle wheel and HI is the starting height or width of the vehicle wheel. Also, the diameter of the cylindrical steel metal blank starting stage should be about 20 millimeters wider than the ultimate desired/specified diameter of the final vehicle wheel diameter (D1=D+20 mm; See FIG. 2). D is the ultimate specified diameter and D1 is about 20 millimeters larger than D. The aforementioned dimension ratios must be observed in order to make a complete and final vehicle wheel that meets the automobile manufacturer's specifications.

Note: It is worth mentioning that the diameter of about 20 mm is extracted, which is unevenly stretch to be uniformly cut in the next step.

Figure 1A:
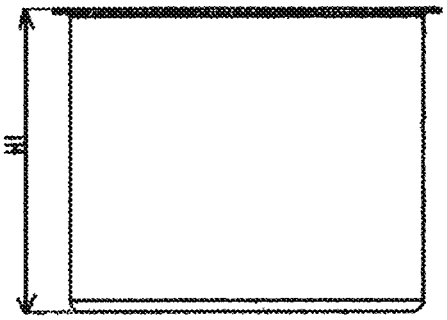
FIGS. 1A and 1B are respectively plan view and isometric view of the primary piece for production vehicle wheel that is drawn the cylindrical.
Figure 1B:
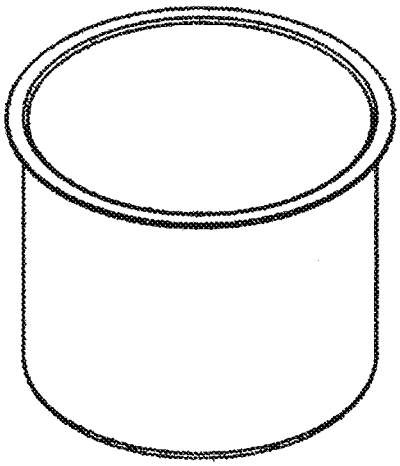
Figure 2A:
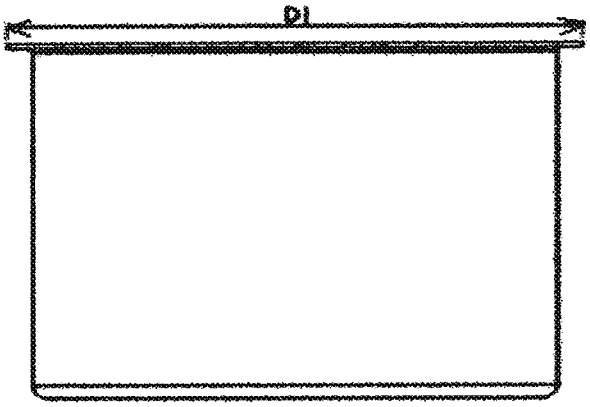
FIGS. 2A and 2B are respectively plan view and isometric view of the cylindrical piece that the edge of diameter is trim.
Figure 2B:
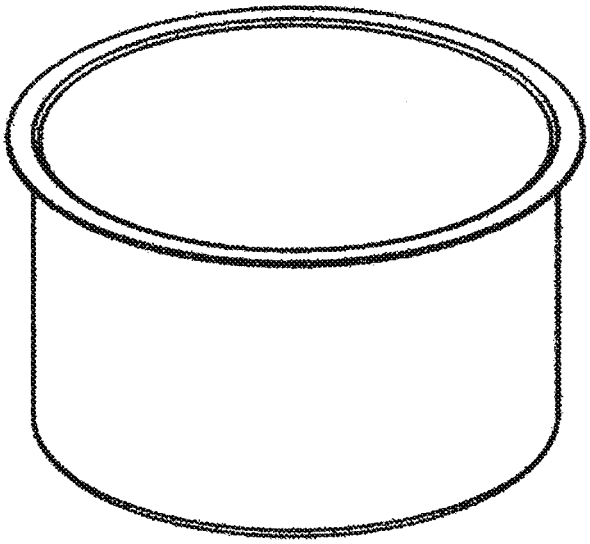

Second Step: Both ends of the cylinder are beveled to the desired shaped of the vehicle wheel. FIG. 1 and FIG. 2 indicates beveled ends.

Figure 3A:
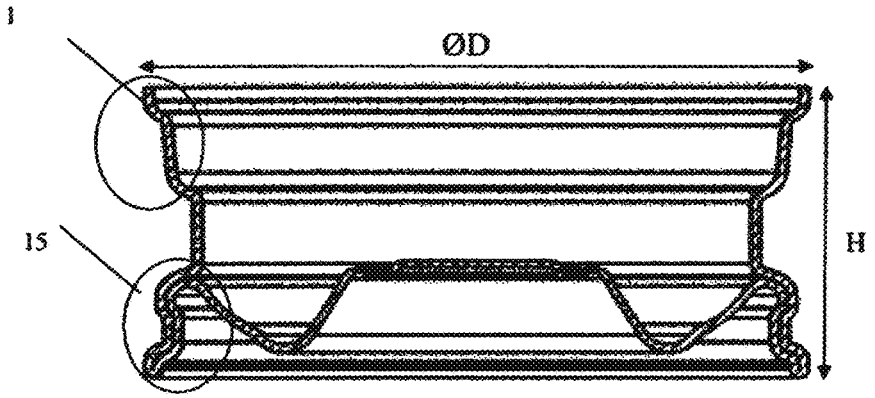
FIGS. 3A and 3B are respectively plan view and isometric view of the vehicle wheel produced by the main process (hydro forming), that double-edged rim is shown.
Figure 3B:
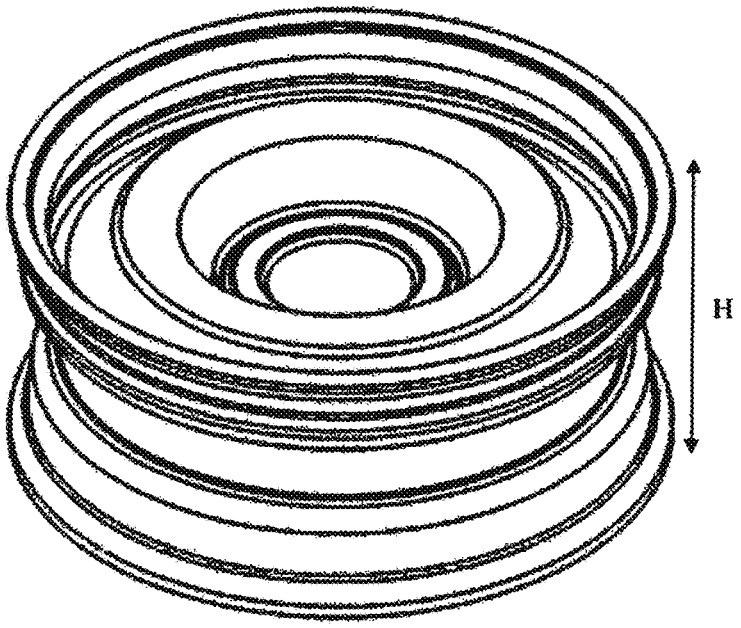

Third Step: At this stage, which is the main stage and in fact the technique of the introduced invention, the formation of the work piece is done by hydro forming method (FIG. 3). This mold is mounted on a special hydraulic press machine, in accordance with FIG. 8, the upper part of the mold consists of a rod [(6); these numbers are references from FIG. 8] in which the fluid path (7) is located in the center of rod to allow the fluid to enter the work piece (8) is embedded in such a way that the fluid is injected into the work piece in the mold by a separate hydraulic unit (not shown in FIG. 8) and after the formation of the mold (to be explained), the fluid in the work piece will necessarily be extracted from the fluid parallel path as a pressure valve (mechanically or electrically). It is noteworthy to mention that this pressure valve produces the required fluid pressure in the work piece for forming and after forming, opens the flow path of the fluid and exits the excess fluid from the mold and work piece back to the fluid reservoir (reservoir not shown).

At the bottom of the mold, there is a matrix (9) that in principle the final shape of the hub is created by the fluid pressure on it. The holder plate of the mold (10) and jaws (11) is mounted on the ejector pins (12) where the ejector pins are located on the bottom jack of the press machine and are placed around the matrix, which, when operating the mold, holder plate, jaws and ejector pins all of them are driven by the overpressure of the jack on top of the press machine, the jaws on the matrix sides, sliding on the holder plate, are opened and closed by two hydraulic jacks (13) during operation, and the form of the final vehicle wheel in the jaws will be finalized by the pressure of the fluid during operation. It is necessary to explain that in the initial form for the production of a prototype, instead of using hydraulic jacks, we used mechanical arms and in this scheme, hydraulic jacks were used to increase the efficiency.

Now, given the brief familiarity with the components of the mold, we will explain the functioning of the mechanism.

First, the height of the bottom jack of the press machine should be adjusted to the extent that the holder plate places the jaws along the edge of the work piece (FIG. 8), then with the start of the machine, simultaneously the jaws of the two sides are closed by the hydraulic jacks (13), a syntax that harnesses the work piece completely (FIG. 8), and simultaneously the fluid is injected into the work piece to the extent that the work piece is completely surrounded with fluid, and then the fluid flow, as indicated by a one way valve in the fluid path is shut off and after the operation, the fluid can be extracted back to the fluid path of the pressure switch, and at the same time the jack on top of the press machine, the upper part of the mold, the rod (6) moves downwards.

Figure 8A:
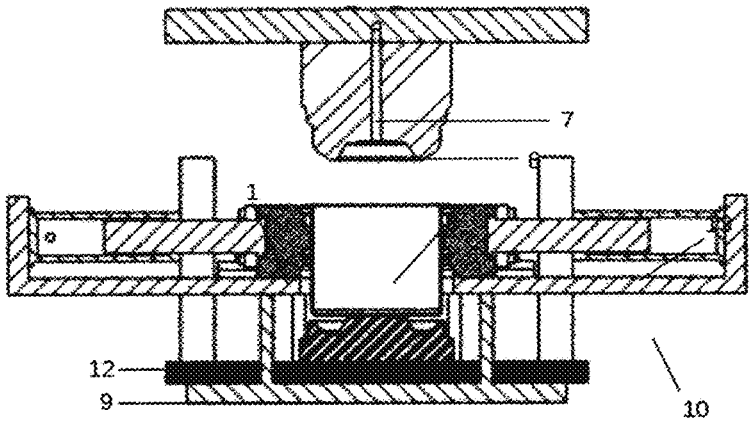
FIGS. 8A and 8B are respectively plan view and isometric view of the open mode die, so work-piece is within the die for formation.
Figure 8B:
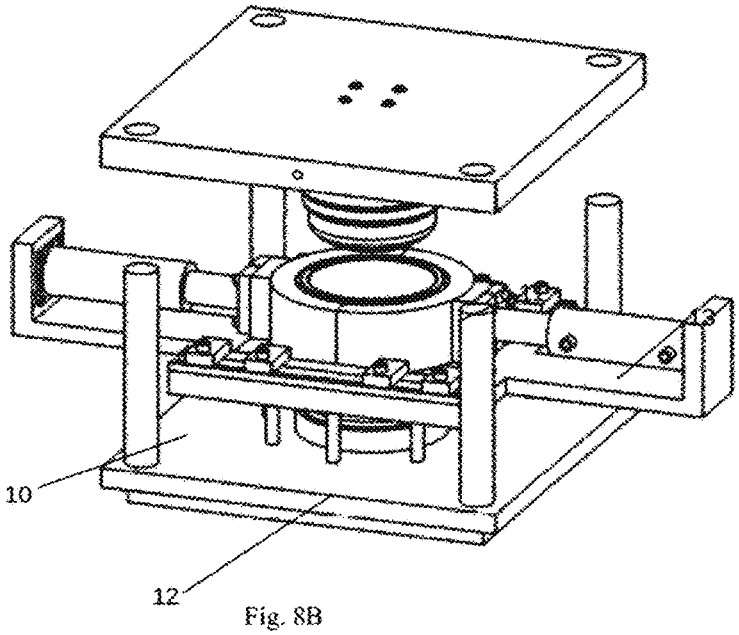
Figure 9A:
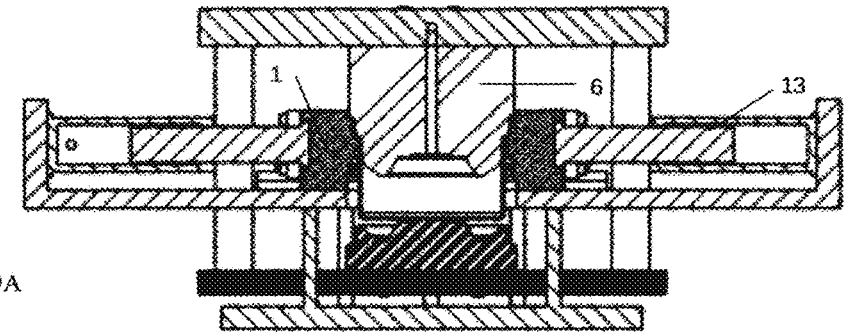
FIGS. 9A and 9B are respectively plan view and isometric view of the action mode die.
Figure 9B:
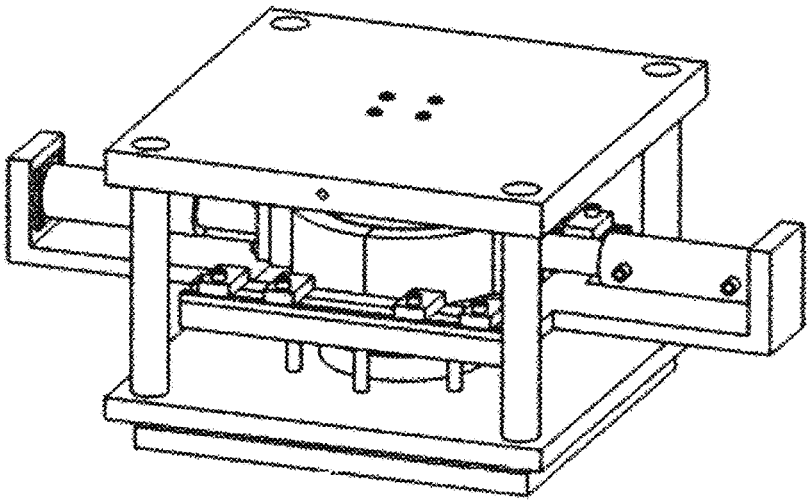

With the involvement of the rod (6) with the work piece, the edge of the work piece between the rod and the edge of the jaw is formed (vehicle wheel edge is shown in FIG. 8), and then the pressure of the lower jack and the pressure of the pressure switch located on the fluid outflow path, the level should be adjusted so that this resistance against the pressure of the jack on top of the press machine causes a significant involvement of the rod and the work piece and the jaws (the edges of the work piece are placed between the rod and the jaws), which results in sealing between the edge of the work piece and rod and does not allow the outflow of fluid to come out, and then, with the overpressure of the jack on top of the press machine, the pressure of the lower jack of the press machine triggers the simultaneous movement of the jaws (which are on the holder plate are installed) goes down.

Figure 10A:
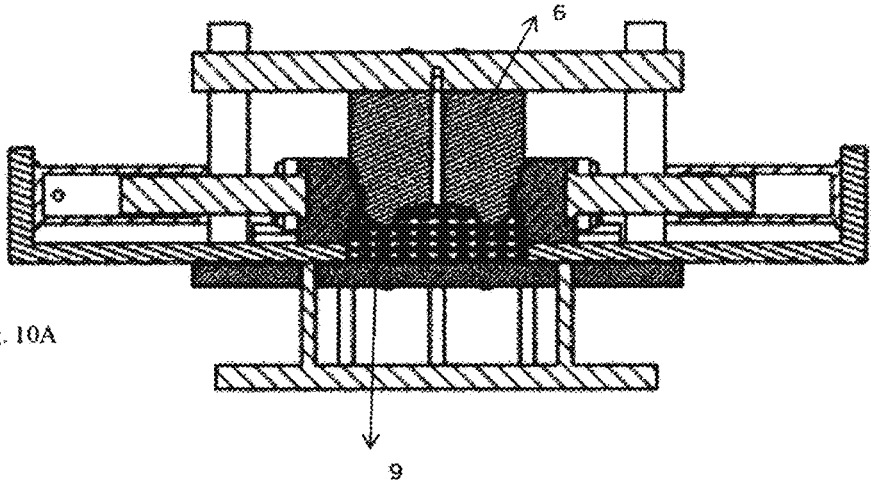
FIGS. 10A and 10B are respectively plan view and isometric view of the final action mode die.
Figure 10B:
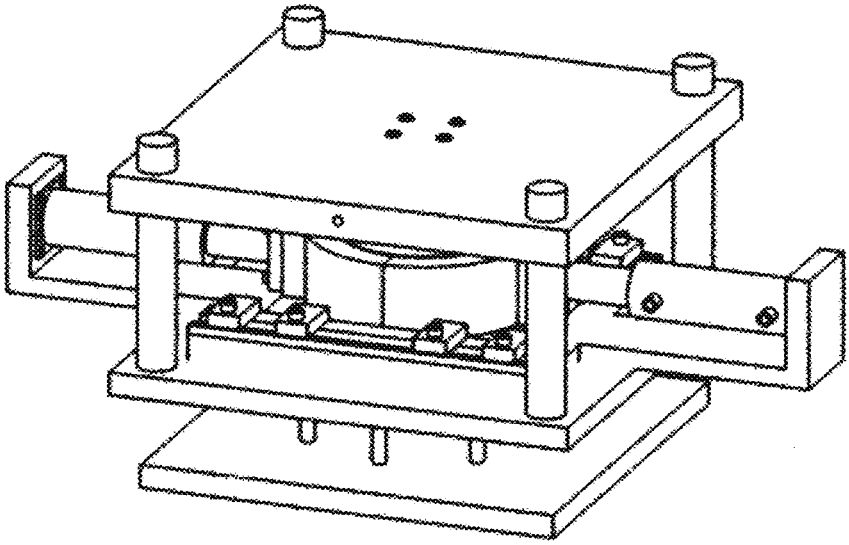
Figure 11A:
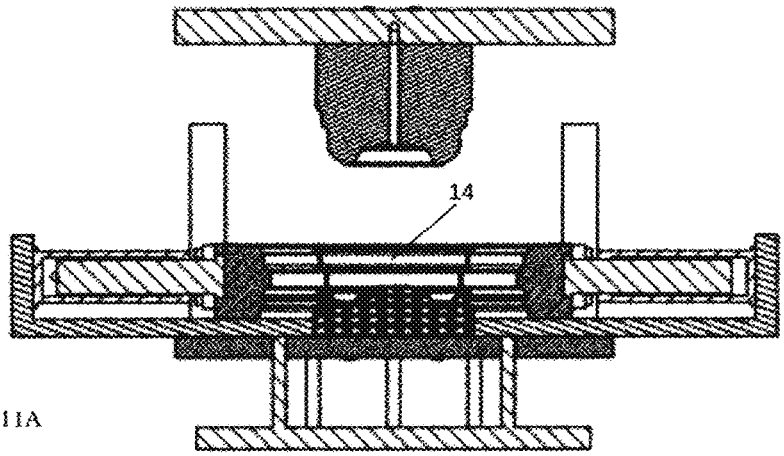
FIGS. 11A and 11B are respectively plan view and isometric view of the final (open) mode die, so the vehicle wheel is final form.
Figure 11B:
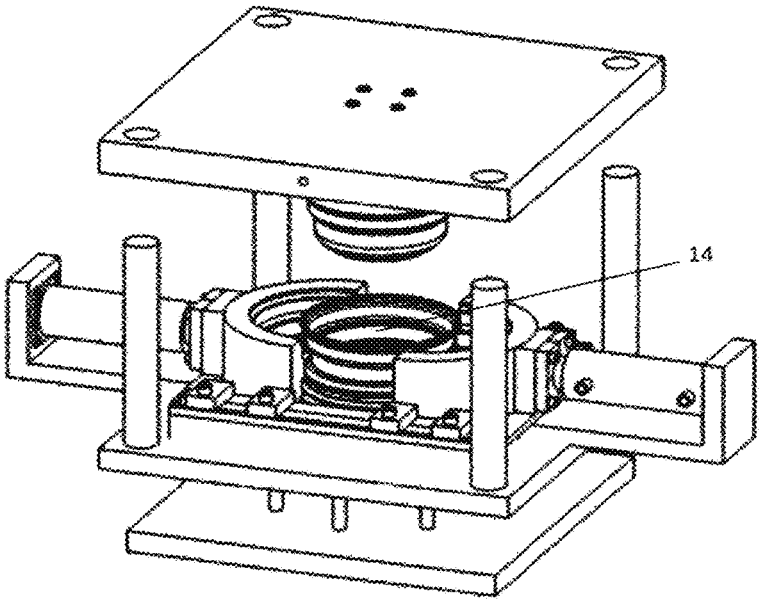

Since the work piece is fixed on the matrix, the pressurized fluid in the work piece is inevitably detained and therefore, folds the work piece form uniform compression (force) towards the empty parts of the mold (forms on the jaws and the matrix) with the continuous increase of pressure and final forming of the work piece, any excess fluid in the work piece is removed from the pressure switch and at the end of the process, in principle, the completion of the forming operation reforms the work piece into the final position and causes forming and creating a double edge in the hub (FIG. 3), then all the fluid on the work piece is removed from the valve of the pressure switch (FIG. 10), and at this time the press machine commands the return to their original open position and at the same time the jack's top and bottom of the press machine return to the open and original state. (FIG. 11)

At the same time, the side jacks (13) open the jaws of the mold and the work piece is completely and the finished product (FIG. 3) is ejected out of the mold and the mold will be ready for the next operation. (FIG. 7).

It needs to be explained that the whole process and the operation of the described mechanisms take about 8 seconds, that is from the start of the machine and injection of the fluid into the work piece and all the steps mentioned, in general the case is simultaneously or in parallel takes about 8 seconds and the mold or machine is ready for the next start, which should be the time when the raw work piece (the cylindrical piece produced in the previous step) is put into place and the withdrawal of the hydro forming formulation piece to the operating time, the press machine, and the hydro forming mechanism (8 seconds) were added. Also, the choice of the hydraulic press machine depends on the type and size of the vehicle wheel and is suitable for vehicle wheel vehicle wheel from 13 to 15 inches of hydraulic press machine 800 tons is prudent.

As shown in (FIG. 3), the entire form is made uniformly by the fluid pressure, and the fluid agent (Fluidity) causes complete uniformity in the entire stretching process, which results in the production of a high quality piece and, on the other hand, the least mass of non-balance, creation of a double edge (FIG. 3) and the removal of the unstable process of welding have been highly developed in the product, and according to the type of process performance, it is clear that the vehicle wheel can easily be fitted to each model with any geometry and any kind of offset produced.

Figure 4A:
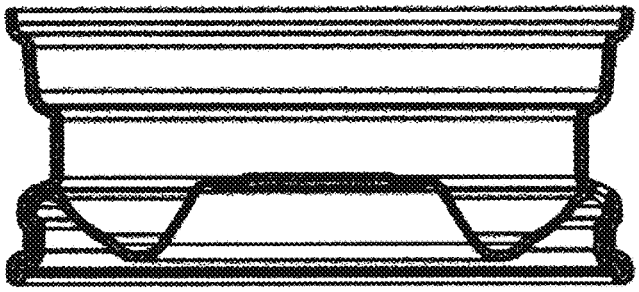
FIGS. 4A and 4B are respectively plan view and isometric view of the vehicle wheel in addition punch valve hole.
Figure 4B:
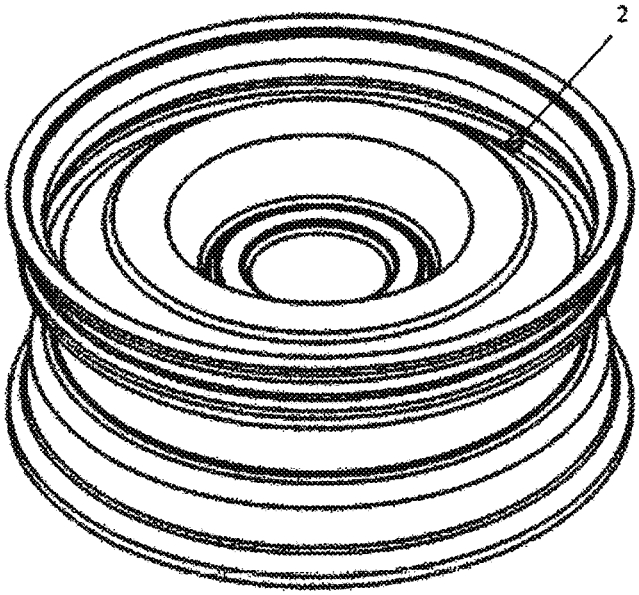

Fourth Step: In this step the valve hole is punched (FIG. 4).

Figure 5A:
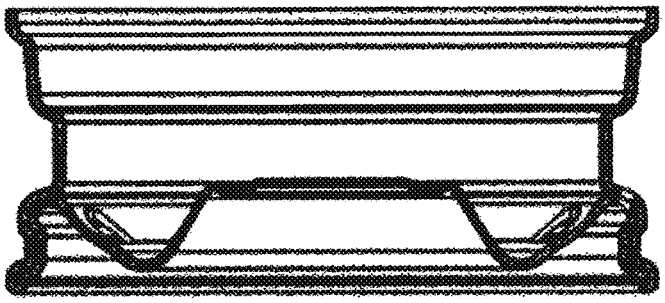
FIGS. 5A and 5B are respectively plan view and isometric view of the vehicle wheel in addition punch air holes.
Figure 5B:
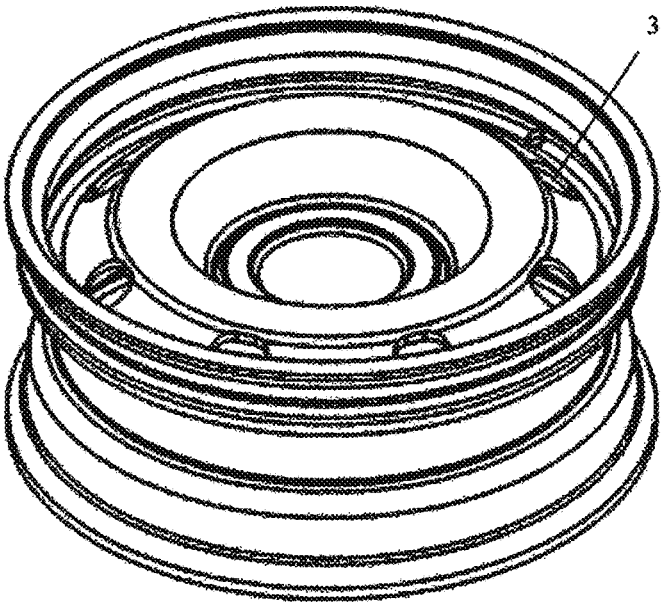

Fifth Step: In this step the air holes are punched (FIG. 5). The air holes can be such a way (as in gaps) to give the spokes the desired and final shape, type and size per the automobile manufacturer specifications from simple round air holes to sophisticated gaps as seen in Aluminum Alloy vehicle wheel.

Figure 6A:
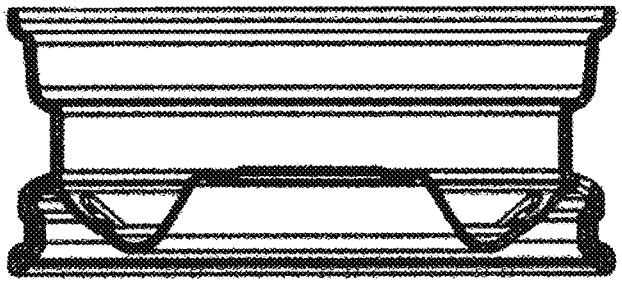
FIGS. 6A and 6B are respectively plan view and isometric view of the vehicle wheel in addition punch preservatives and center holes.
Figure 6B:
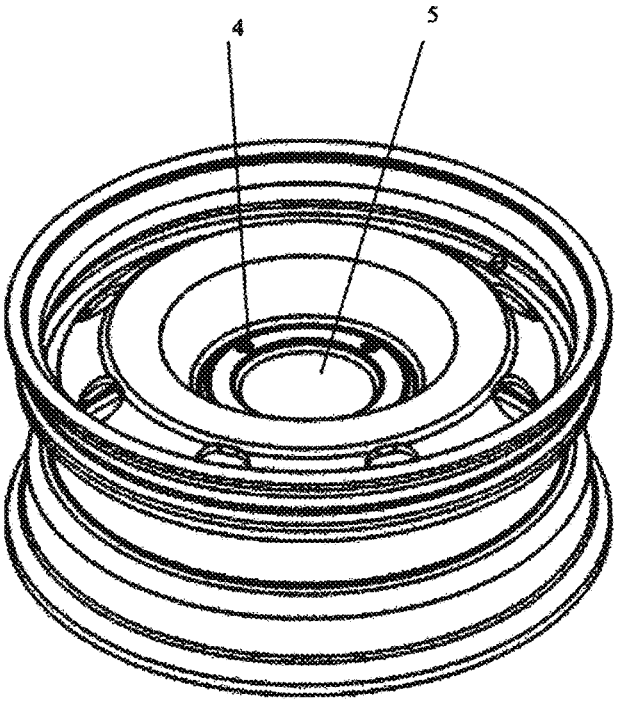

Sixth Step: In this step the central hole is punched (FIG. 6).

Seventh Step: Bolt holes (also referred on the FIG. 6 as the preservative holes) are punched and drilled to the automobile manufacturer's specifications.

Eight and final Step: The edge of the holes is rounded and the outside of the vehicle wheel where visible is smoothened and shined, coated, or painted to the automobile manufacturer's specifications (FIG. 7).

Porotypes of the introduced hydro forming molding to design and build vehicle wheel as well as other products and samples can be manufactured by the same mold are shown in FIG. 12.

It is emphasized regarding the final product of the automobile manufacturer's coating specification, if production steel material made of "ST 12" is utilized, the vehicle wheel requires coating. However, if specified material made of "Stainless Steel" is utilized, the final coating can be eliminated and provides a shiner, more attractive and higher quality vehicle wheel products.

The introduction of this hydro forming molding method can manufacture high quality, faster and less cost automobile vehicle wheel out of one piece steel material and the need for the traditional method to manufacture high cost, lower quality, and slower production vehicle wheel made of two piece welded vehicle wheel with hub cabs can be eliminated forever.

The invention claimed is:

1. A method of fabricating a single-piece vehicle wheel including a rim and a hub, comprising the steps of:

a) providing a strip of a steel sheet metal;

b) forming said steel sheet metal strip into a cylinder; having an open end and a closed end, having a height of at least 1.3 to 1.8 times longer than a finished height of said wheel;

c) trimming said open end of said cylinder to a desired dimension;

d) placing said trimmed cylinder on a special hydraulic press machine;

e) hydro-forming said trimmed cylinder into a desired shape; wherein said machine comprises an upper mold rod and a bottom mold matrix for forming a hub; wherein said upper mold rod comprises an embedded fluid path vertically passing through a center length of said upper mold rod, where fluid enters inside said trimmed cylinder; wherein said press machine further comprising multiple ejector pins located on a bottom jack of said press machine and around said bottom mold matrix; and a holder plate that is fixedly attached to said multiple ejector pins; two hydraulic jacks extending out from said holder plate, each having a jaw facing towards said trimmed cylinder and holding said trimmed cylinder fixedly in place during said hydro-forming step; wherein each of said jaws having a height equal to or longer than said trimmed cylinder height, therefore completely encompassing said trimmed cylinder inside; said press machine further comprises a pressure valve for opening and closing said fluid path for entrance of pressurized fluid of a fluid reservoir inside said trimmed cylinder during said hydro-forming step and guiding excess fluid out of said wheel when said hydro-forming step is completed; and wherein a design and shape of said upper mold rod, said bottom mold matrix and each of said jaws creating said desired shape after said trimmed cylinder is hydro-formed;

f) adjusting a height of said bottom jack and therefore said holder plate to an extent where each of said jaws are placed along said trimmed edges of said cylinder, therefore sealing said trimmed edge with said upper mold rod and therefore preventing an outflow of said fluid during said hydro-forming step;

g) closing each of said jaws via said two hydraulic jacks;

h) harnessing said trimmed cylinder in place and simultaneously injecting said fluid inside said trimmed cylinder via said fluid path wherein said trimmed cylinder is completely surrounded with said fluid; and moving down said upper mold rod and shutting off said fluid via said pressure valve;

i) adjusting pressure of said fluid and a pressure applied by said upper mold rod and each of said jaws so that said fluid forces said trimmed cylinder to fold and form via a uniform compression towards empty spaces of each of said jaws and said bottom mold matrix;

j) removing said fluid and commanding said upper mold rod and said bottom matrix of said press machine to return to their original positions; and k) opening each of said jaws and releasing said wheel, wherein steps (a) through (k) are performed in the recited order.

2. The method of claim 1, wherein said pressure valve is a one-way mechanical or electrical valve.

3. The method of claim 2, further comprising the steps of:

l) punching a valve hole, air holes, a central hole and plurality of bolt holes on said wheel;

m) rounding an edge of each of said valve hole, said air holes, said central hole and said plurality of bolt holes; and n) coating and painting visible outer edges of said wheel.

4. The method of claim 3, further comprises the following steps:

o) adjusting a height of said bottom jack, therefore placing each of said jaws of said holder plate along said trimmed edges of said trimmed cylinder;

p) closing each of said jaws by said hydraulic jacks at the starting up/turning on of said press machine; and at the same time injecting said fluid inside said trimmed cylinder via said one-way pressure valve.

* * * * *